US011114236B2

(12) United States Patent
Bertuzzi

(10) Patent No.: US 11,114,236 B2
(45) Date of Patent: Sep. 7, 2021

(54) BAND FEEDING PROCESS AND SYSTEM AS WELL AS PLANT FOR THE PRODUCTION OF LAMINATED CORES FOR TRANSFORMERS

(71) Applicant: L.A.E. Lughese Attrezzature Per L'Elettromeccanica S.R.L., Lugo (IT)

(72) Inventor: Ales Bertuzzi, Lugo (IT)

(73) Assignee: L.A.E. LUGHESE ATTREZZATURE PER L'ELETTROMECCANICA, Lugo (IT)

( * ) Notice: Subject to any disclaimer, the term of this patent is extended or adjusted under 35 U.S.C. 154(b) by 0 days.

(21) Appl. No.: 16/617,336

(22) PCT Filed: May 31, 2018

(86) PCT No.: PCT/IB2018/053909
§ 371 (c)(1),
(2) Date: Nov. 26, 2019

(87) PCT Pub. No.: WO2018/220585
PCT Pub. Date: Dec. 6, 2018

(65) Prior Publication Data

US 2020/0350118 A1 Nov. 5, 2020

(30) Foreign Application Priority Data

May 31, 2017 (IT) ..... 102017000059495

(51) Int. Cl.
*H01F 7/06* (2006.01)
*H01F 41/02* (2006.01)

(52) U.S. Cl.
CPC ..... *H01F 41/0206* (2013.01)

(58) Field of Classification Search
CPC ..... H01F 41/0206
See application file for complete search history.

(56) References Cited

U.S. PATENT DOCUMENTS 4,413,406 A * 11/1983 Bennett ..... B32B 37/1292 228/190
4,578,860 A * 4/1986 Tanaka ..... H01F 41/0233 29/738

(Continued)

FOREIGN PATENT DOCUMENTS

JP S5662306 5/1981

OTHER PUBLICATIONS

International Search Report and Written Opinion of the International Search Authority dated Oct. 5, 2018, for International Application PCT/IB2018/053909, filed May 31, 2018, Applicant, L.A.E. Lughese Attrezzature Per L'Elettromeccanica S.R.L. (12 pages).

(Continued)

*Primary Examiner* — Paul D Kim
(74) *Attorney, Agent, or Firm* — McCracken & Gillen LLC

(57) ABSTRACT

A band feeding process, a band feeding system and a plant for the production of cores with stacked grain-oriented laminations for transformers are disclosed. The plant includes a processing unit to cut a band made of a ferromagnetic metal material, in particular made of magnetic silicon steel, so as to obtain one or more laminations. The processing unit includes an input, and the plant includes a feeding system having plurality of feeding stations. Each feeding station is configured to feed a respective band to the input.

20 Claims, 8 Drawing Sheets

(56) References Cited

U.S. PATENT DOCUMENTS

| | | | | | |
|---|---|---|---|---|---|
| 5,050,294 | A * | 9/1991 | Ballard | H01F 41/0226 | 29/609 |
| 5,261,152 | A * | 11/1993 | Simozaki | H01F 41/0226 | 29/609 |
| 5,285,565 | A * | 2/1994 | Ballard | H01F 41/0226 | 29/609 |
| 5,671,526 | A * | 9/1997 | Merlano | H01F 41/0233 | 29/609 |
| 9,978,513 | B2 * | 5/2018 | Looby | H01F 41/0226 | |
| 2009/0280338 | A1 | 11/2009 | Christian | | |
| 2012/0047718 | A1 * | 3/2012 | Ikeda | H01F 41/0226 | 29/606 |
| 2016/0020021 | A1 | 1/2016 | Looby | | |

OTHER PUBLICATIONS

Office Action issued in the counterpart Chinese application No. 201810552286.2, Applicant, L.A.E. Lughese Attrezzature Per L'Elettromeccanica S.R.L., dated Mar. 23, 2021, including English Summary (9 pages).

* cited by examiner

BAND FEEDING PROCESS AND SYSTEM AS WELL AS PLANT FOR THE PRODUCTION OF LAMINATED CORES FOR TRANSFORMERS

PRIORITY CLAIM

This application claims priority from Italian Patent Application No. 102017000059495 filed on May 31, 2017, the disclosure of which is incorporated by reference.

TECHNICAL FIELD

This patent application relates to a band feeding process and system for a plant for the production of laminated cores for transformers, in particular for the production of cores with stacked grain-oriented laminations for electrical energy transmission and distribution transformers, namely for transformers with a power exceeding 10 kVA.

This patent application further relates to a plant for the production of laminated cores for transformers, in particular for the production of cores with stacked grain-oriented laminations for electrical energy transmission and distribution transformers, namely for transformers with a power exceeding 10 kVA.

BACKGROUND ART

Laminated cores of this type are large-sized and significantly heavy, thus requiring suitable production plants and manipulation instruments. For example, laminated cores of the type described above usually comprise a lower joke, an upper joke and a plurality of columns, which transversely connect the lower joke and the upper joke to one another. For power or distribution applications, the columns of the cores can have lengths ranging, for example, from 0.5 to 5 metres.

In order to manufacture these laminates cores, it is known to produce and stack a plurality of laminations made of magnetic silicon steel by means of a process comprising three different steps:

- providing a plurality of spools of magnetic silicon steel band having different widths;
- cutting the bands into different lengths, so as to obtain a plurality of metal laminations, in particular with different widths and lengths;
- assembling the metal laminations so as to form lamination stacks or complete the transformer core.

It should be pointed out, in particular, that the material used to manufacture these laminated cores, namely the magnetic silicon steel band, is a fairly thick material, which cannot be excessively bent, because this would cause the degradation of the silicon component.

Therefore, these cores are manufactured through the combination and overlapping of a plurality of flat laminations, which are never subjected to bending.

Furthermore, in order to manufacture the components of the core, it is necessary to often replace the spools, so as to feed bands having different widths, in a succession that depends on the geometry to be obtained.

Known plants have a feeding station where a spool is unwound so as to feed, through an input, a band to a processing unit, in order to cut and separate the band.

In case the band needs to be replaced by another one, for example for the production of laminations with a different widths, the spool is replaced.

In particular, known plants comprise one single multi-spindle reel, wherein each spindle supports a respective spool. Therefore, the band exchange in a known plant basically comprises the following steps:

- completely rewinding the band being processed on the respective spool;
- rotating the reel so as to move the spindle with the replacing spool to the area of the feeding station;
- introducing the band in the processing line; and
- setting the band.

This process is affected by the drawback of having to completely interrupt the production of the plant for a significant amount of time, ranging, based on the type of transformer to be manufactured, from 10% to 15% of the total production time.

DISCLOSURE OF INVENTION

The object of the invention is to provide a feeding process and system, which allow the band to be exchanged in a few seconds.

According to the invention, there is provided a process to feed a band material to a plant for the production of laminated cores for transformers as claimed in the appended claims.

According to the invention, there is provided a band feeding system for a plant for the production of laminated cores for transformers as claimed in the appended claims.

According to the invention, there is provided a plant for the production of laminated cores for transformers as claimed in the appended claims.

BRIEF DESCRIPTION OF THE DRAWINGS

The invention will now be described with reference to the accompanying drawings, which show non-limiting embodiments thereof, wherein.

BEST MODE FOR CARRYING OUT THE INVENTION

Figure 1:
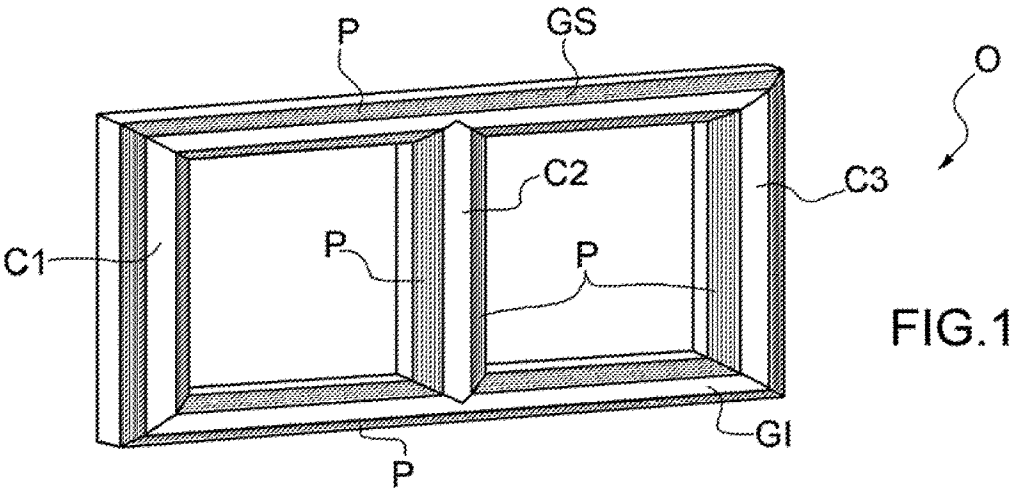
FIG. 1 is a schematic view of a core with stacked grain-oriented laminations for energy transmission and distribution transformers.
Figure 2:
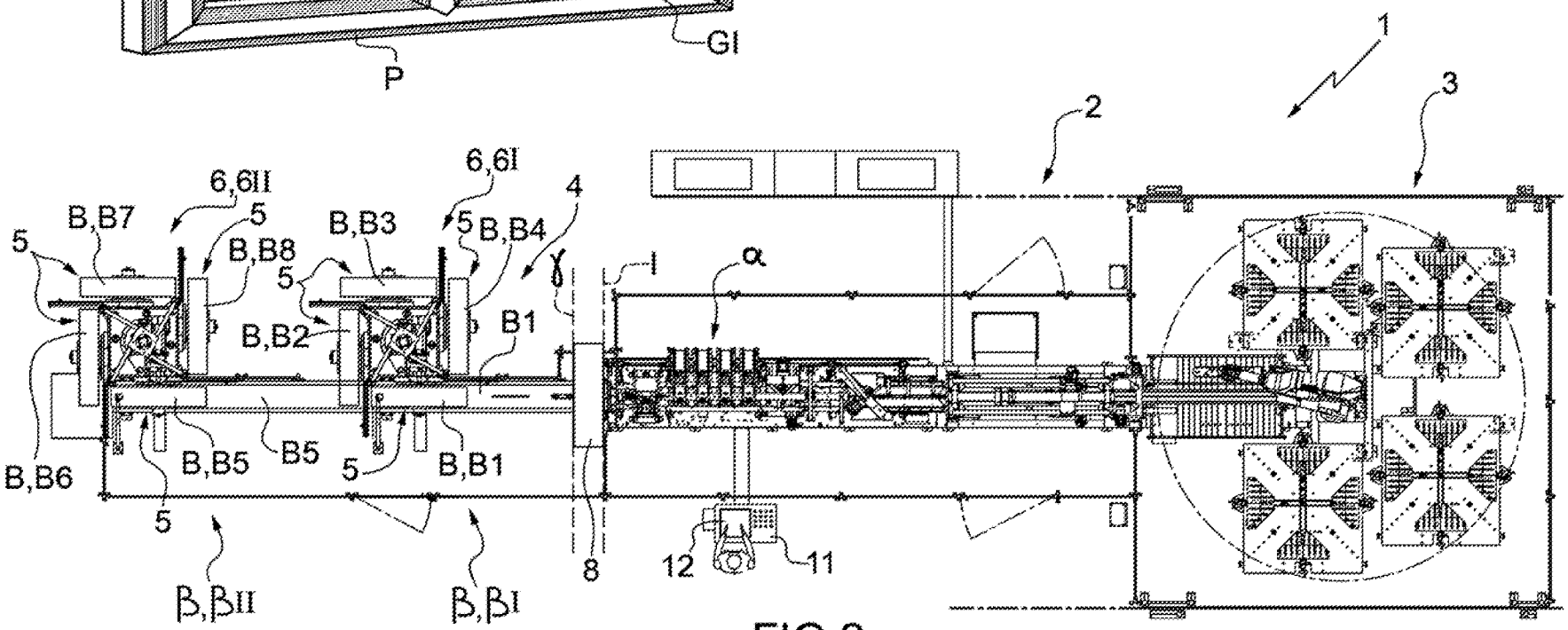
FIG. 2 is a plan view of a plant according to the invention.

In FIG. 1, O indicates, as a whole, a laminated core, in particular for distribution or power transformers, namely for electrical energy transmission and distribution transformers, namely for transformers with a power exceeding 10 kVA. The core O comprises, in a known manner, a lower joke GI and an upper joke GS, which are transversely connected to one another by a plurality of columns C. According to the example shown, there are three columns, two side ones indicated with C1 and C3 and a central one indicated with C2. Each joke GI, GS and each column are manufactured by overlapping a plurality of laminations P made of magnetic silicon steel. Each joke GI, GS is connected to respective ends of the columns C1, C2 and C3 by means of a shape coupling, in particular by means of a herringbone coupling.

Advantageously, at least part of the core O described above was manufactured by cutting and overlapping the laminations P starting from one single band B.

The plant 1 comprises, in a known and schematically shown manner, a processing unit 2, which has, in turn, one or more cutting stations α arranged in series, where the singles laminations P are cut and separated from one another starting from a ferromagnetic metal material band B, in particular made of magnetic silicon steel. The plant 1 further comprises a stacking unit 3 downstream of the processing unit 2, where stacks of laminations P are obtained (in a known manner) in order to form the jokes GI, GS and the columns C1, C2 and C3.

The plant 1 further comprises a feeding system 4, which is configured, as explained more in detail below, to feed a band B selected among a plurality of different bands, in particular having different widths, to the processing unit 2 in a basically instantaneous manner. This feeding system 4 find advantageous application especially when the band B in the processing unit 2 needs to be replaced. In particular, the processing unit 2 has an interface input I interfaced with the feeding system 4, thus allowing bands B coming from the feeding system 4 to get into the processing station 2.

Figure 3:
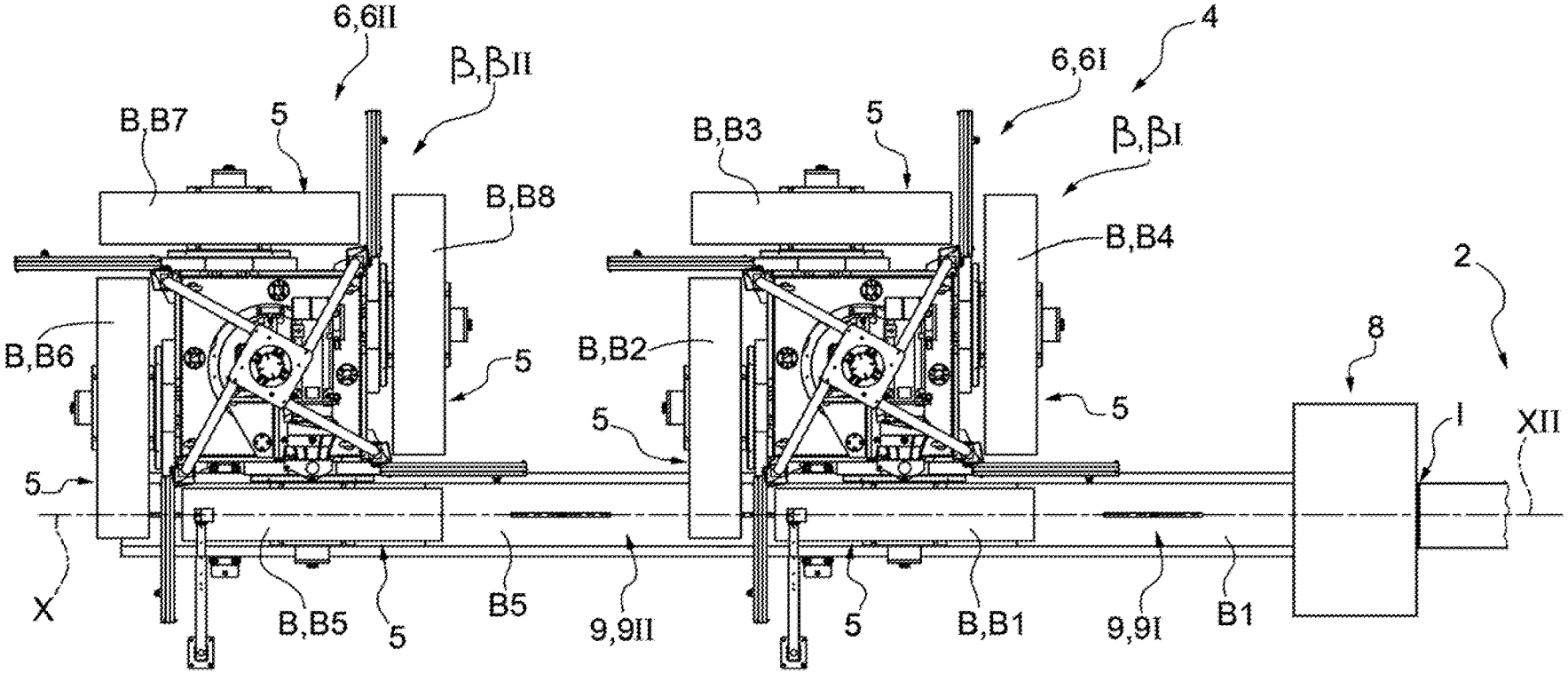
FIG. 3 is a plan view of a detail of FIG. 2.

According to what is shown more in detail in FIG. 3, the feeding system 4 has a plurality of feeding stations β, each configured to feed a respective band B to the input I.

It should be pointed out that, hereinafter, the terms "upstream" and "downstream" are used with reference to the feeding direction of a band B from the respective feeding station β towards the input I.

In particular, the feeding system 4 is configured to selectively feed a plurality of continuous bands B1-B8, which are wound in spools 5 and are made of a ferromagnetic material, namely a material that is suited to be used to manufacture laminations P of a transformer core K. In particular, the feeding system 4 is configured to feed, starting from respective spools 5, bands B1-B8 made of magnetic silicon steel.

The feeding system 4 comprises a known and schematically shown reel 6 for each feeding station β. Advantageously, each reel 6 is configured to support, unwind and rewind in a known manner a respective spool 5. In particular, each reel 6 comprises a spindle 7, which is rotary and is configured to unwind and rewind, in a known manner, a respective spool 5.

According to the example shown in the figures, the feeding system 4 has tow feeding stations, hereinafter indicated with βI and βII. Advantageously, the feeding stations βI and βII are connected in parallel to the input I, as described more in detail below.

The feeding system 4 comprises a reel 6I and 6II for each feeding station βI and βII, respectively.

Each reel 6I, 6II comprises, in turn, a plurality of spindles 7. In the example shown, each reel 6I, 6II comprises four spindles 71-74 and 75-78. Each reel 6I, 6II is rotary around a vertical axis AI, AII and is configured to place, in a known manner, and in the area of the respective feeding station βI, βII, a band B selected among its group of bands B1-B4 and B5-B8, respectively, which are installed and available.

Advantageously, the feeding system 4 comprises an exchange unit 8, which is arranged upstream of the input I. The exchange unit 8 interposed between each feeding station β and the input I.

Advantageously, the plant 1 comprises a plurality of guides 9, each of which is configured to guide the band B from a respective feeding station β to the exchange unit 8. According to the example shown, the feeding system 4 comprises two guides, hereinafter indicated with 9I and 9II.

Advantageously, the guides 9I and 9II have longitudinal axes X, which are parallel to one another. The guides 9I and 9II overlap one another so that each band B is aligned with a predetermined machine axis XII of the processing unit 2.

Advantageously, the exchange unit 8 is configured to connect, in use, to the input I a guide 9 selected in the group of guides 9I and 9II.

Figure 4:
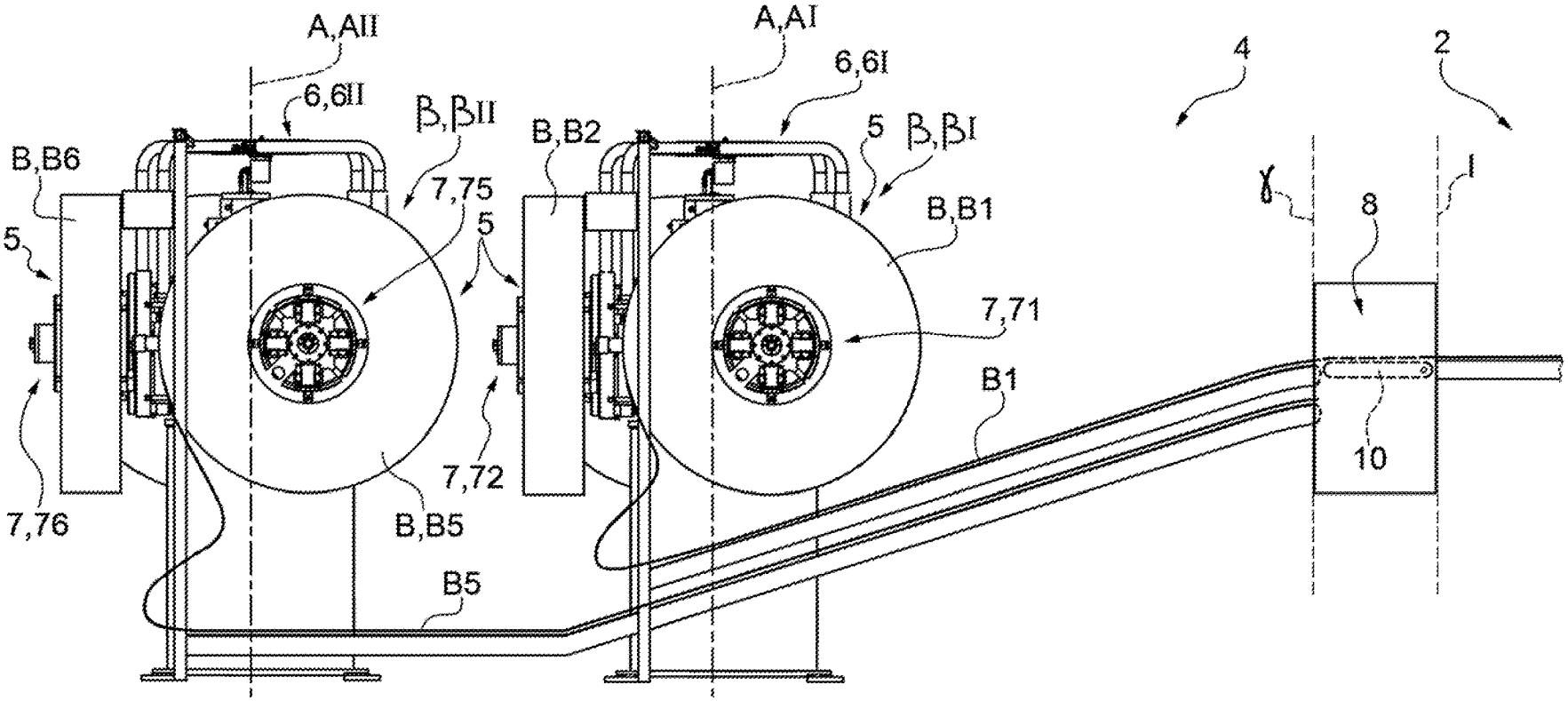
FIG. 4 is a side view of the detail of FIG. 3.
Figure 5:
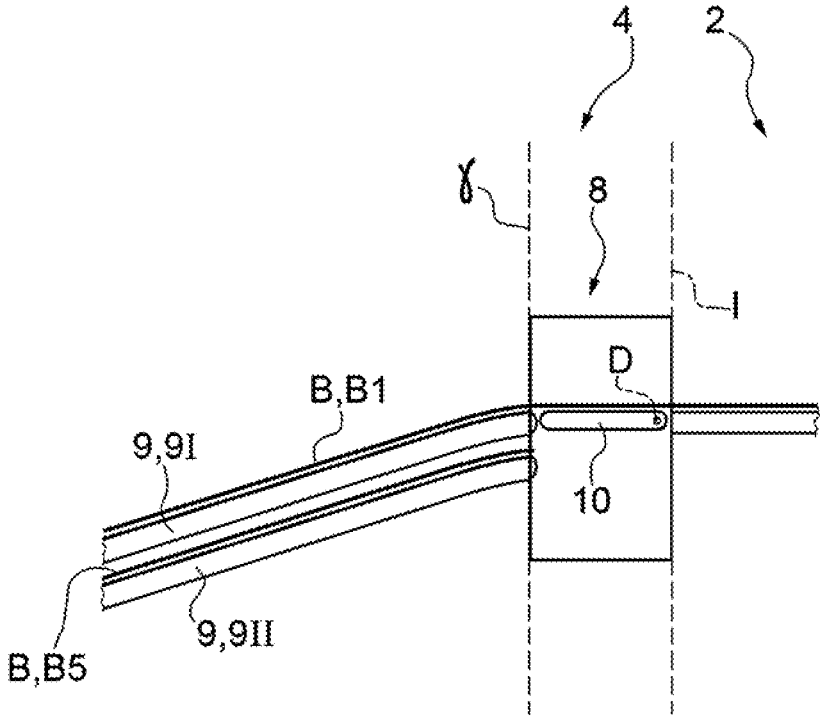
FIG. 5 is a schematic view of a further detail of FIG. 1 in a first operating configuration.

According to the embodiment shown in FIGS. 3 and 4, the exchange unit 8 is interposed between each feeding station β and the input I. According to the embodiment shown in figures from 7 to 11, the exchange unit 8 is under the guides 9.

It should be point out that, without losing in generality, according to non-shown variants, the feeding system 4 can comprise a different number of feeding stations β and, accordingly, of reels 6 and guides 9. In other words, the feeding system 4 can comprise: three or more feeding stations β; three or more guides 9; three or more reels 6.

According to the example shown, the exchange unit 8 comprises a switch 10, which is configured to connect to the input I a guide 9 selected between the guides 9I and 9II.

According to the example shown, the switch 10 is an oscillating body, which, depending on its position relative to a rotation axis of its, connects a respective guide 9 to the input I.

According to a non-shown variant, the switch 10 is a translating body, which can be selectively arranged in a plurality of different positions, each permitting the connection of a respective guide 9 to the input I. Alternatively, according to the embodiment shown in figures from 7 to 11, the exchange unit 8 at least partly translates the guides 9, in particular at least the end portion of the guides 9, so as to align them with the input I.

According to FIGS. 7 to 11, the guides 9 are hinged in correspondence of a free end opposite to the exchange unit 8. According to the shown embodiment, the guides 9 are at least partially overlapped, in particular the guide 9I lays on an end portion of the guide 9II. The guide 9II is hinged in the area of a free end 100 opposite to the exchange unit 8 to rotate around a rotation axis Y. In particular, the rotation axis Y is parallel to the support plane and is perpendicular to the longitudinal axis X of the guide 9II. By so doing, the guides 9I and 9II are integral to each other during the rotation around the rotation axis Y.

According to figures from 7 to 11, the exchange unit 8 comprises a switch 110, which is configured to move the guides 9I and 9II transversely, in particular perpendicularly, to the support plane so as to rotate the guides 9I and 9II around the rotation axis Y.

According to figures from 7 to 11, the switch 110 comprises a cylinder 111 connected to the guide 9II and0 interposed between the guide 9II and the support plane. By so doing the guides 9I and 9II face directly the input I.

Figure 10:
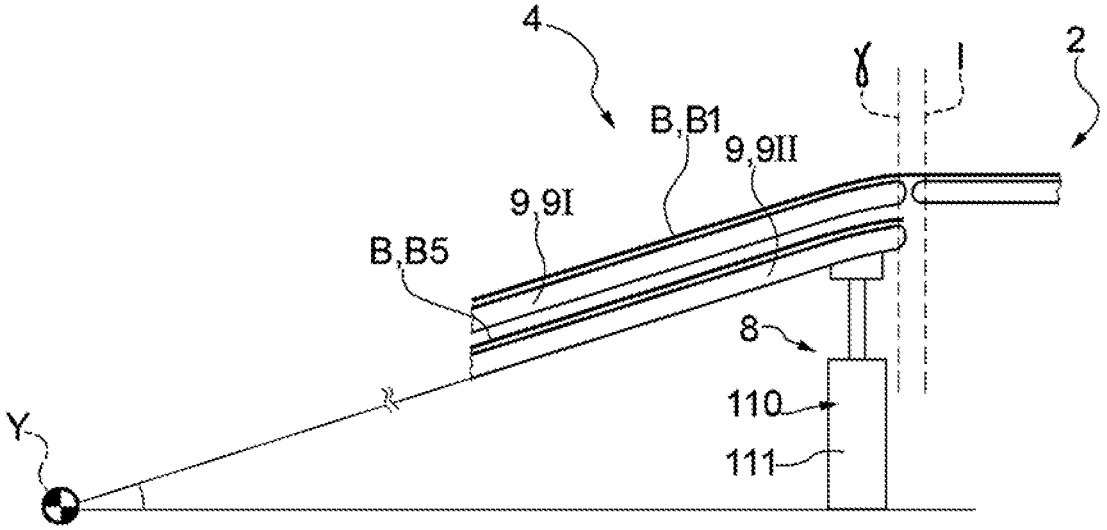
FIGS. 10 and 11 are schematic views of a particular of FIG. 8 in a first and in second, respectively, operating configuration.
Figure 11:
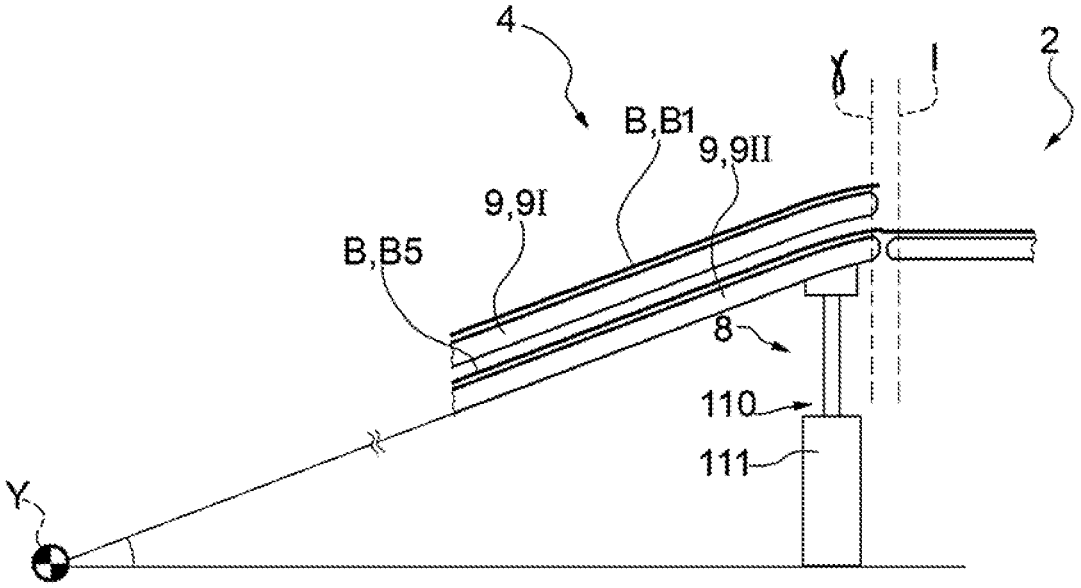
Figure 12:
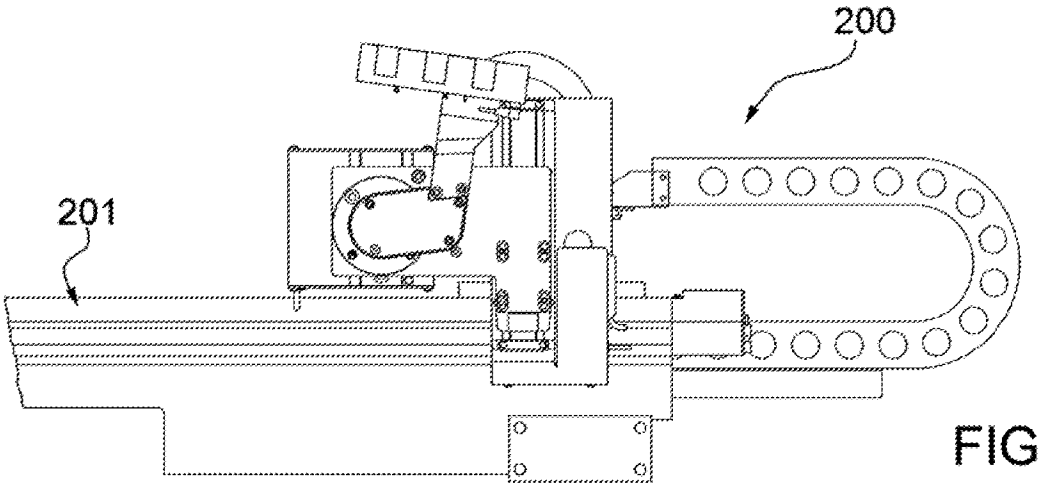
FIG. 12 is a lateral view of a particular of FIG. 8.
Figure 13:
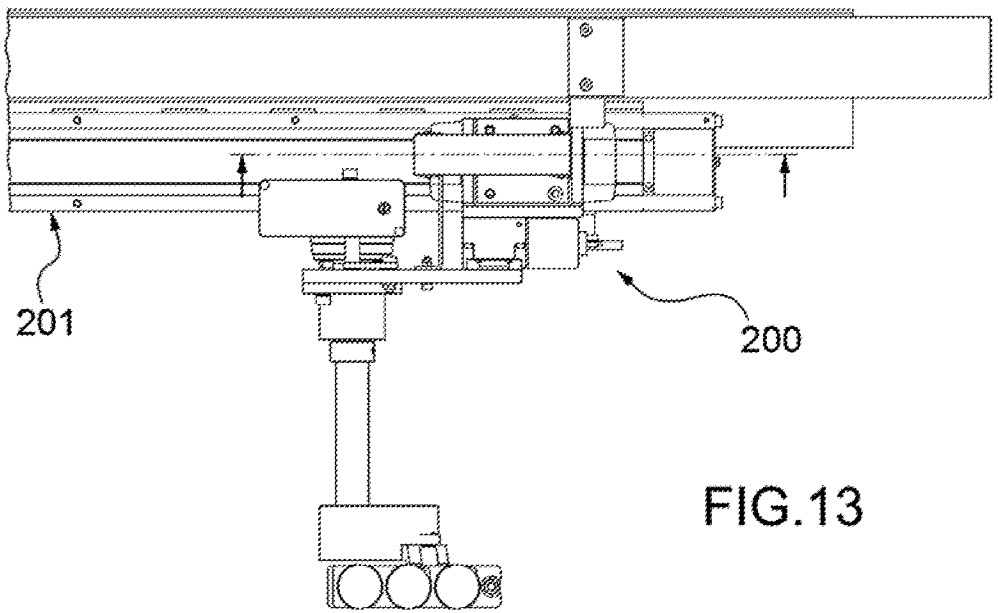
FIG. 13 is a plant view of FIG. 12.
Figure 14:
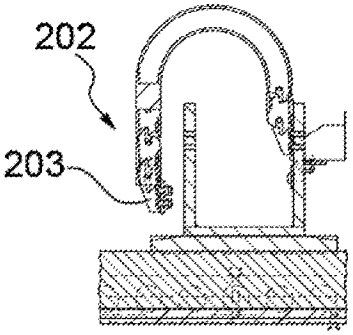
FIG. 14 is a section according to line XIV-XIV of FIG. 13.

In other words, the exchange unit 8 is disposed beneath the guides 9. In this way, the feeding system 4 is compact. FIG. 10 shows the guide 9I in connection with the input and FIG. 11 shows the guide 9II in connection with the input I.

Advantageously the feeding system 4 can comprise mutando mutandis a more guides 9 and respective reels 6.

The feeding system 4 further has a waiting station γ, which is arranged upstream of the exchange unit 8. In the embodiment shown in figures from 7 to 11, the waiting station γ corresponds at the end portions of the guides 9I and 9II facing the input I Advantageously, the plant 1 further comprises a control system 11, which is configured to exchange data with the processing unit 2, each reel 6, each spindle 7 of the reels and the exchange unit 8. The control system 11 is configured to rotate each reel 6 based on the type of processing to be carried out.

Advantageously, the control system 11 is configured to exchange data with and adjust the operation of each spindle 7, based on the type of processing to be carried out.

Advantageously, the control system 11 is configured to adjust the operation of the switch 10 or 110 of the exchange unit 8, based on the type of processing to be carried out.

Advantageously, the control system 11 comprises a user interface 12, through which the control system 11 exchanges data with an operator. For example, the user interface 12 comprises a display or a mobile device and/or a remote unit, for example a pc or a tablet.

Figure 7:
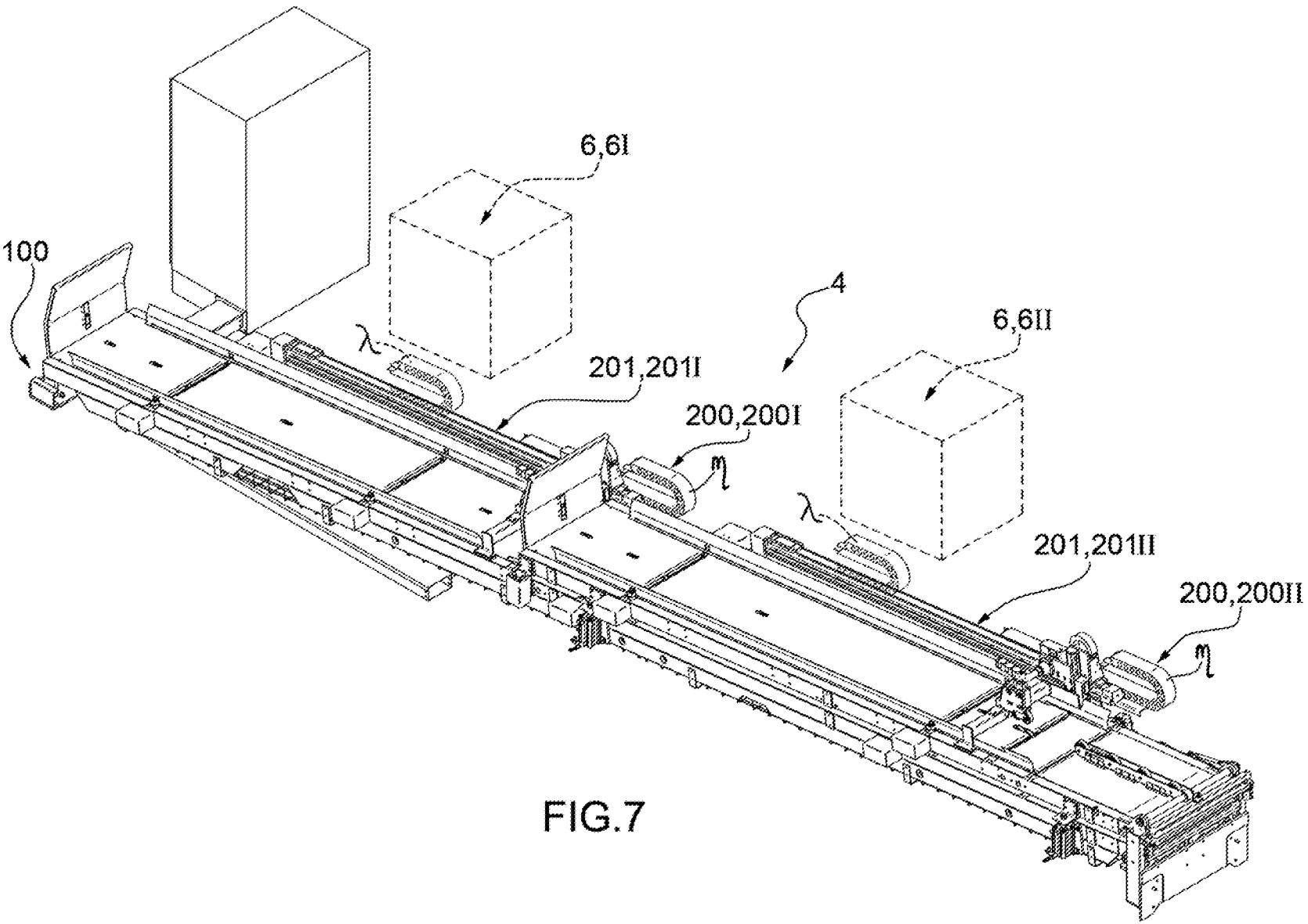
FIG. 7 is a prospective view of a second embodiment of the particular of FIGS. 3 and 4.
Figure 8:
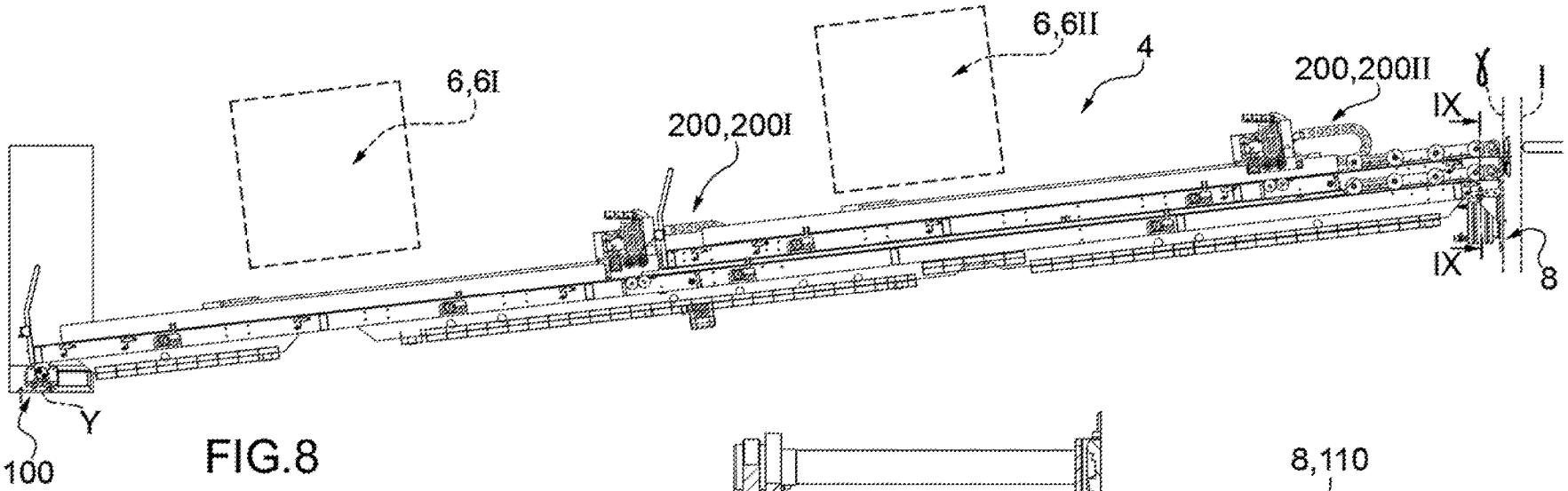
FIG. 8 is a lateral view of FIG. 7.
Figure 9:
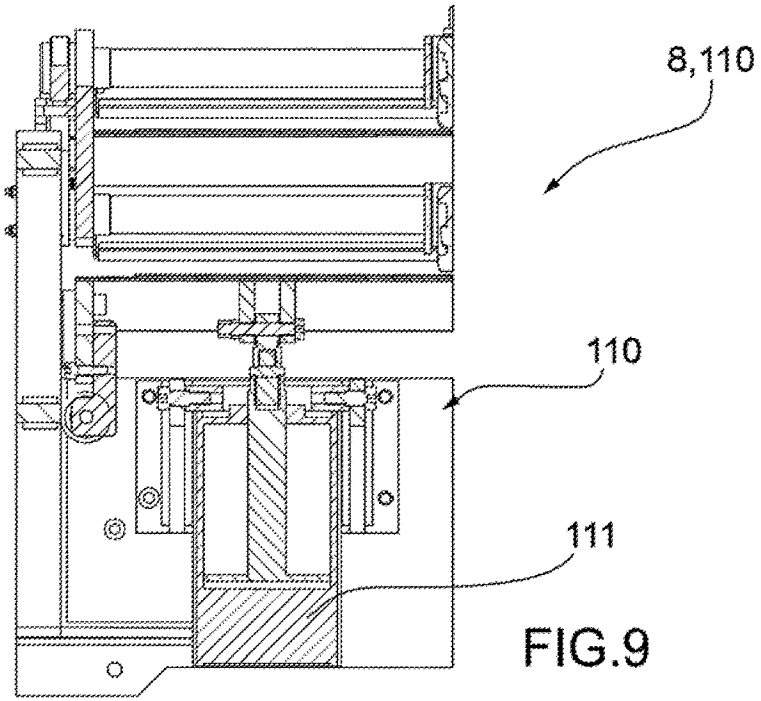
FIG. 9 is a section according to line IX-IX of FIG. 8.

Advantageously according to FIG. 7 and from 12 to 14, the feeding system 4 comprises a Cartesian manipulator 200I, 200II for each guide 9I and 9II, respectively. The Cartesian manipulators 200I and 200II are substantially equal to each other and in the following only a generic manipulator 200 will be described for conciseness. Each manipulator 200 comprises a guide 201, which is substantially parallel to the respective guide 9, and a gripping head 202 which is mounted so as to slide along said guide 201 from a parking position η to a working position λ and viceversa. The gripping head 202 comprises a gripper 203 and is configured to grip a portion of a band B and introduce it in the processing line. In particular, the gripping head 202 is configured to introduce the end portion of a band B between the respective guide 9 and some motorized wheels, which are configured to push the band B along the respective guide 9 towards the waiting station γ. The gripper 203 can be electromagnetic, can comprise pneumatic gripping systems and/or suckers and/or other equivalents elements, for example interlocking elements or interfering elements.

In use, according to the example shown in the figures, the band B1 is coupled, in a known manner which is not shown herein, to the respective guide 9I. Then, in a known manner which is not shown herein, initialization operations are carried out based on the width of the band B1, namely operations to align the band B1 itself with the machine axis of the cutting unit 2.

Subsequently, the band B1 is fed, in a known and schematically shown manner, to the processing unit 2 through the waiting station γ, the exchange unit 8 and the input I.

Advantageously, in masked time, namely while a band B engages a guide 9 and is being processed, the feeding system 4 carries out an initialization operation on another, still free guide 9, so as to prepare a replacing band B. During the initialization operation, the initial flap of the replacing band B is brought up to the waiting station γ, where the feeding of the replacing band B is interrupted.

According to the example shown in the figures, while the band B1 is fed to the processing unit 2, the feeding system 4 carries out the initialization operation of the replacing band B5 on the guide 9II. In particular, during the initialization operations, the initial flap of the replacing band B2 is brought up to the waiting station γ. The feeding of the replacing band B5 is interrupted when it reaches the waiting station γ.

In case the band B being processed needs to be replaced, the procedure to exchange the band B is started.

During the exchange of the band B, the band B inside the processing unit 2 is forced to go back. In particular, it is rewound around its spool 5. Once the input I and the exchange unit 8 have been freed, in particular once the initial flap of the of the rewound band B ha reached an upstream position relative to the initial flap of the replacing band B, the switch 10 of the exchange unit is operated so as to allow the replacing band B to be fed through the input I of the processing unit 2.

Then, the replacing band B is fed in a known manner, until the following exchange of the band B is requested.

Based on the example shown, when the band is exchanged, the band B1 is forced to go back, namely is rewound around its own spool 5, until the initial flap of the of the band B1 is interposed between the respective spindle 71 and the waiting station γ.

Figure 6:
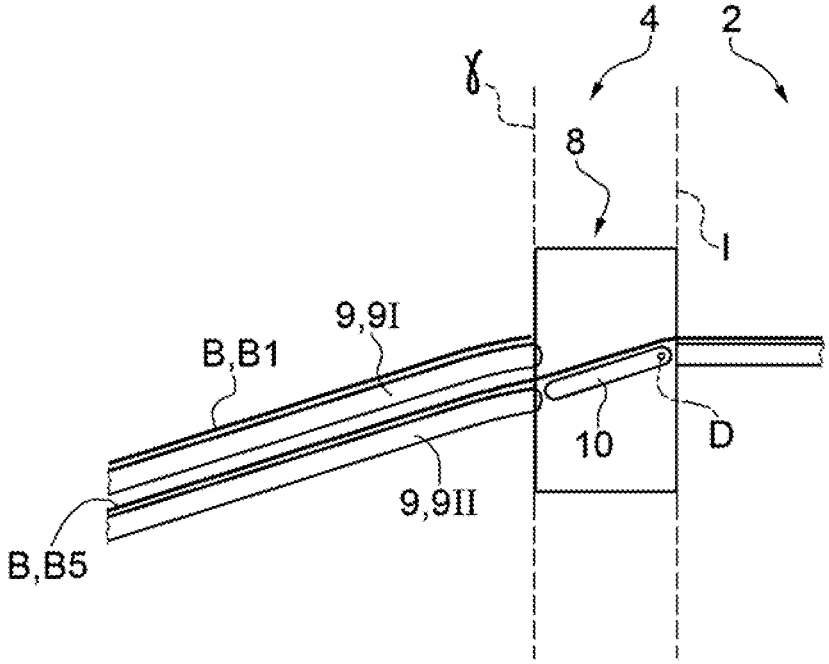
FIG. 6 is similar to FIG. 5 and shows the further detail in a second operating configuration.

Then, the switch 10 or 110 is operated so as to connect the guide 9II to the input I (FIG. 6).

Subsequently, the band B5 is fed so as to go through the input I and reach, in a known manner, the processing unit 2.

The processing of the band B5 goes on until the following band exchange.

Advantageously, when the band B is caused to go back, it can be completely rewound around its own spool 5, so as to permit the rotation of the respective reel 6 and the positioning of a further band B in the area of the respective feeding station β. In this way, the replacement of the band B fed to the processing unit 2 is obtained. Furthermore, the initialization operations of the further band B can be carried out in masked time, as explained above.

Advantageously, the initialization operations of the further band B can be realized automatically by means of the each manipulator 200.

As an alternative, advantageously, when a band B is forced to go back, it can be left lying on the respective guide 9 with its initial flap arranged close to the waiting station γ. By so doing, the band B is already available, without having to carry out the initialization operations again in case it has to be used immediately after the processing of the replacing band B.

Owing to the above, the feeding process, the feeding system 4 and the plant 1 described above allow the band B being processed in the processing unit 2 to be replaced in extremely reduced times (a few seconds) compared to the amounts of time currently needed in known plants.

Indeed, the feeding process, the feeding system 4 and the plant 1 described above allow the initialization operations to be performed on a band B to be fed to the processing unit 2 to be carried out in masked time. In other words, the initialization of band B takes place while the plant 1 is working, hence the plant 1 does not need to be stopped any longer for the replacement of the band B.

Furthermore, advantageously, the feeding process, the feeding system 4 and the plant 1 described above can work in an automatic and continuous manner, the presence of the operators being necessary only for the installation of the spools 5 on the respective spindles 7 and/or to couple the initial flap of a band B to a respective guide 9.

Therefore, according to the feeding process, the feeding system 4 and the plant 1 described above, there is only a short break of a few seconds (the time needed for the switching of the exchange unit 8) in case the band B in the processing unit 2 needs to be replaced.

The invention claimed is:

1. A feeding process for a plant for production of cores with stacked laminations for transformers, the plant comprising a processing unit and a feeding system, the processing unit having an input, the feeding system comprising a plurality of feeding stations, each feeding station configured to feed a respective band to the input, the feeding process comprising the steps of:

feeding to the input a band coming from a selected feeding station of the plurality of feeding stations; and cutting, by means of said processing unit, the band from the selected feeding station, wherein the band is made of a ferromagnetic metal material so as to obtain one or more laminations.

2. The process according to claim 1, wherein the feeding system has a waiting station, which is interposed between each feeding station and said input, wherein, while band is fed by the selected feeding station to the input, a further band is fed by a respective further feeding station to the waiting station.

3. The process according to claim 1, wherein the feeding system comprises a plurality of guides, each of which connects a respective feeding station to a waiting station, and an exchange unit, wherein said guides are rotatably mounted to rotate about a rotation axis further including the step of operating the exchange unit to rotate said guides around the rotation axis so as to connect to said input a guide chosen among said guides.

4. The process according to claim 1, wherein the feeding system comprises a plurality of guides, each of which connects a respective feeding station to a waiting station, wherein the feeding system comprises an exchange unit, which is interposed between said guides and said input, and further including the step of operating the exchange unit to connect to said input a guide chosen among said guides.

5. The process according to claim 1, wherein the feeding system comprises an exchange unit the exchange unit being configured to selectively convey, in use, each band coming from each feeding station towards the input, wherein the process further comprises a band change step involving the band that includes operating the exchange unit to allow a band chosen among the bands fed by said feeding stations to pass towards the input.

6. The process according to claim 5, wherein the feeding system has a first and a second feeding station, the first and the second feeding stations being configured to feed a first and, respectively, a second band; the plant comprising a first and a second guide, said first guide being configured to guide a respective band from the first feeding station to the exchange unit, said second guide being configured to guide a respective band from the second feeding station to the exchange unit, the exchange unit being configured to connect, by choice, the first guide or the second guide to said input, the feeding system having a waiting station for each guide, the process further comprising:

a first step of feeding the first band coming from a respective first feeding station to the processing station through said input; and a second step of feeding the second band coming from a respective second feeding station to a respective waiting station, wherein said second feeding step takes place while the first feeding step is carried out.

7. The process according to claim 6, wherein, in case of change of the band, the following steps are carried out in sequence:

a third recalling step to recall the first band out of the input;

a fourth exchange step, during which the exchange unit is operated so as to connect said second guide to the input; and a fifth step of feeding the second band from the respective waiting station to the input.

8. The process according to claim 1, wherein the feeding system comprises, in the area of each feeding station, a reel comprising, in turn, a plurality of spindles, on each of which a respective spool of band can be installed; wherein each band is fed, or recalled, by unwinding, or winding, the respective spool.

9. The process according to claim 8, wherein the band fed by a respective feeding station can be replaced by rotating said reel so as to change the spool present in the area of the feeding station.

10. The process according to claim 1, further comprising: unwinding a band from a respective spool; and automatically inserting the band from the respective spool along a respective guide.

11. The process according to claim 1, wherein the laminations are grain-oriented.

12. The process according to claim 1, wherein the band comprises magnetic silicon steel.

13. A feeding system to feed a band for a production of cores with stacked laminations for transformers, comprising:

a plurality of feeding stations;

an exchange unit, wherein said feeding stations are connected in parallel to the exchange unit;

a processing unit having an input, wherein the exchange unit feeds a band selected from a plurality of bands fed by said plurality of feeding stations to the input; and a plurality of guides, each guide conveys one of the plurality of bands from a respective feeding station to the exchange unit, wherein the exchange unit connects a guide chosen from the plurality of guides to the input.

14. The system according to claim 13, further comprising a reel for each feeding station to feed a respective band in the area of a respective feeding station, wherein each reel comprises a plurality of spindles, and wherein a respective spool of band can be installed, in use, on each spindle.

15. The system according to claim 13, wherein said guides are rotatably mounted to rotate about a rotation axis; said exchange unit rotates said guides around the rotation axis so as to connect to said input a guide chosen among said guides.

16. The system according to claim 13, wherein the feeding system has a first and a second feeding station and said exchange unit being interposed, in use, between said input and said first and second feeding station; the feeding system comprising a first and a second guide, said first guide guides a band from the first feeding station to the exchange unit, said second guide guides a band from the second feeding station to the exchange unit, and the exchange unit selectively connects the first guide or the second guide to the input.

17. The feeding system of claim 13, wherein the laminations are grain-oriented.

18. A plant for the production of cores with stacked laminations for transformers, the plant comprising a processing unit to cut a band made of a ferromagnetic metal material so as to obtain one or more laminations, said processing unit having an input; and a feeding system according to claim 13.

19. The plant in accordance with claim 18, wherein the laminations are grain-oriented.

20. The plan in accordance with claim 18, wherein the ferromagnetic metal material comprises magnetic silicon steel.

* * * * *